US011704961B2

(12) United States Patent
Loose

(10) Patent No.: US 11,704,961 B2
(45) Date of Patent: Jul. 18, 2023

(54) GAMING SYSTEMS AND METHODS FOR DISPLAY FLICKER REDUCTION

(71) Applicant: LNW Gaming, Inc., Las Vegas, NV (US)

(72) Inventor: Timothy C. Loose, Chicago, IL (US)

(73) Assignee: LNW Gaming. Inc., Las Vegas, NV (US)

( * ) Notice: Subject to any disclaimer, the term of this patent is extended or adjusted under 35 U.S.C. 154(b) by 186 days.

(21) Appl. No.: 17/141,412

(22) Filed: Jan. 5, 2021

(65) Prior Publication Data

US 2021/0217271 A1 Jul. 15, 2021

Related U.S. Application Data

(60) Provisional application No. 62/959,626, filed on Jan. 10, 2020.

(51) Int. Cl.
*G07F 17/32* (2006.01)
*G06Q 50/34* (2012.01)

(52) U.S. Cl.
CPC ..... *G07F 17/3211* (2013.01); *G07F 17/3223* (2013.01); *G06Q 50/34* (2013.01)

(58) Field of Classification Search
CPC . G07F 17/3211; G07F 17/3223; G06Q 50/34; H05B 45/00; H05B 45/30; H05B 45/32; H05B 45/33; H05B 45/335; H05B 47/155
See application file for complete search history.

(56) References Cited

U.S. PATENT DOCUMENTS 5,689,301 A * 11/1997 Christopher ..... H04N 7/0115 348/E7.015
6,819,311 B2 11/2004 Nose et al.
7,235,934 B2 6/2007 Hung et al.
7,277,079 B2 10/2007 Kobayashi et al.
7,811,170 B2 10/2010 Winans et al.
7,864,204 B2 1/2011 Overes
(Continued)

OTHER PUBLICATIONS

Hecht et al., "Intermittent Stimulation by Light", The Journal of General Physiology, 1935, 11 pages.
(Continued)

*Primary Examiner* — Dmitry Suhol
*Assistant Examiner* — Jason Pinheiro

(57) ABSTRACT

A gaming machine includes an auxiliary lighting assembly including at least one light-emitting device, a display device, and a display controller in communication with the display device and the auxiliary lighting assembly. The display controller transmits a display pulse signal and display data to the display device to cause the display device to present display content by selectively emitting light based on the display pulse signal that defines an active period of light emission and an inactive period without light emission, generates an auxiliary lighting pulse signal based on one or more signal characteristics of the display pulse signal, synchronizes the auxiliary lighting pulse signal at a phase offset from the display pulse signal, and transmits the synchronized auxiliary lighting pulse signal to the auxiliary lighting assembly to cause the auxiliary lighting assembly to selectively emit light based on the synchronized auxiliary lighting pulse signal.

20 Claims, 8 Drawing Sheets

(56) References Cited

U.S. PATENT DOCUMENTS 8,162,751 B2 * 4/2012 Kopera ..... G07F 17/3202 463/30
8,749,538 B2 6/2014 Webster et al.
9,547,952 B2 1/2017 Brunell et al.
2002/0049975 A1 * 4/2002 Thomas ..... G06Q 50/34 725/60
2003/0017865 A1 * 1/2003 Beaulieu ..... G07F 17/3213 463/16
2004/0053663 A1 * 3/2004 Paulsen ..... G07F 17/3211 463/16
2004/0166917 A1 * 8/2004 Lam ..... G07F 17/3211 463/16
2004/0166932 A1 * 8/2004 Lam ..... G07F 17/3202 463/30
2005/0261057 A1 * 11/2005 Bleich ..... G07F 17/34 463/30
2007/0165406 A1 7/2007 Wang
2009/0118007 A1 * 5/2009 Nakaya ..... G07F 17/3211 463/31
2010/0188443 A1 7/2010 Lewis et al.
2011/0201411 A1 * 8/2011 Lesley ..... G07F 17/3244 463/25
2012/0098960 A1 4/2012 Fujino et al.
2014/0187307 A1 * 7/2014 Morimoto ..... G07F 17/3209 463/20
2014/0187308 A1 * 7/2014 Morimoto ..... G07F 17/3213 463/20
2014/0235339 A1 * 8/2014 Matsushita ..... H05B 47/165 463/31
2015/0031454 A1 * 1/2015 Decker ..... G07F 17/3202 463/35
2017/0170906 A1 * 6/2017 Holtman ..... H04N 23/73
2017/0178444 A1 * 6/2017 Lee ..... G07F 17/3211
2018/0352626 A1 12/2018 Komanduri et al.

OTHER PUBLICATIONS

"Driving the Flicker-Free Effect", Unios, 2019, 15 pages.
Lee et al., "White-LED Backlight Control for Motion-Blur Reduction and Power Minimization in Large LCD TVs", Journal of the Society for Information Display, 2009, 18 pages.

* cited by examiner

GAMING SYSTEMS AND METHODS FOR DISPLAY FLICKER REDUCTION

CROSS-REFERENCE TO RELATED APPLICATIONS

This application claims the benefit of priority to U.S. Provisional Application No. 62/959,626, filed Jan. 10, 2020, the contents of which are hereby incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2020, SG Gaming, Inc.

FIELD

The present disclosure relates generally to gaming systems, apparatus, and methods and, more particularly, to display and lighting configurations of gaming systems for reducing flicker from display light strobing.

BACKGROUND

Many modern display devices, such as liquid crystal displays (LCDs), employ a sample-and-hold technique to display video content. That is, the display devices retrieve a frame of video content (a "sample") and maintain the frame for a period of time before retrieving a subsequent frame. This is due in part to the underlying mechanisms used to display content, which may require some time to transition to a different state. For example, in LCDs, the liquid crystals may require time to transition between states. This maintaining of a particular frame may result in a phenomenon known as "motion blur". That is, for moving objects displayed on a sample-and-hold display device, humans may perceive moving objects according to a path of natural movement, yet the display device maintains discrete samples without providing an interpolated path between two adjacent discrete samples. This discrepancy may cause viewers of the display devices to observe the moving object as blurry. In an industry such as the gaming industry that employs a variety of moving display content, motion blur is typically undesirable.

At least some known sample-and-hold displays employ techniques and/or mechanisms to combat or otherwise eliminate motion blur. For example, some display devices reduce the time between frames through an increased refresh rate (i.e., how often the display device is updated). However, increasing refresh rate may be costly in monetary value, content development (i.e., display content may require optimization for different refresh rates), and/or computational resources. Other known display devices do not increase refresh rate, but rather display each frame for a limited amount of time. For example, some display devices use a backlight assembly to emit light to present display content. The backlight may be configured to selectively emit light such that a "black frame" (i.e., the backlight stops emitting light for a period of time) is inserted between two frames of the display content, thereby reducing the duration of each frame. This may also be referred to herein as "backlight strobing".

However, this black frame insertion technique may cause other visual inconsistencies. For example, at lower refresh rates, the display devices may emit a noticeable "flicker" from the black frames, which may be undesirable to viewers. For the gaming industry, the irritation of the flicker effect may cause potential players to leave or avoid gaming machines. Accordingly, there is a need for a display system that accounts for both motion blur and flicker to produce a substantially smooth presentation of display content.

SUMMARY

According to one aspect of the present disclosure, a gaming machine includes a cabinet, an auxiliary lighting assembly coupled to the cabinet and including at least one light-emitting device, a display device coupled to the cabinet, and a display controller in communication with the display device and the auxiliary lighting assembly. The display controller transmits a display pulse signal and display data to the display device to cause the display device to present display content associated with one or more casino wagering games by selectively emitting light based on the display pulse signal that defines an active period of light emission and an inactive period without light emission, generates an auxiliary lighting pulse signal based at least partially on one or more signal characteristics of the display pulse signal, synchronizes the auxiliary lighting pulse signal with the display pulse signal, the synchronized lighting pulse signal being phase offset from the display pulse signal, and transmits the synchronized auxiliary lighting pulse signal to the auxiliary lighting assembly to cause the auxiliary lighting assembly to selectively emit light based on the synchronized auxiliary lighting pulse signal. The phase offset between the display pulse signal and the synchronized auxiliary lighting pulse signal causes the auxiliary lighting assembly to emit light during at least a portion of the inactive period of the display device.

According to another aspect of the disclosure, a method for reducing flicker caused by display devices using a gaming system is provided. The gaming system includes a cabinet, an auxiliary lighting assembly coupled to the cabinet and including at least one light-emitting device, a display device coupled to the cabinet, and a display controller in communication with the display device and the auxiliary lighting assembly. The method includes transmitting, by the display controller, a display pulse signal and display data to the display device to cause the display device to present display content associated with one or more casino wagering games by selectively emitting light based on the display pulse signal that defines an active period of light emission and an inactive period without light emission, generating, by the display controller, an auxiliary lighting pulse signal based at least partially on one or more signal characteristics of the display pulse signal, synchronizing, by the display controller, the auxiliary lighting pulse signal with the display pulse signal, the synchronized lighting pulse signal being phase offset from the display pulse signal, and transmitting, by the display controller, the synchronized auxiliary lighting pulse signal to the auxiliary lighting assembly to cause the auxiliary lighting assembly to selectively emit light based on the synchronized auxiliary lighting pulse signal. The phase offset between the display pulse signal and the synchronized auxiliary lighting pulse signal causes the auxiliary lighting assembly to emit light during at least a portion of the inactive period of the display device.

According to yet another aspect of the disclosure, a gaming system includes a gaming machine and a display controller. The gaming machine includes a cabinet, a display device, and an auxiliary lighting assembly including at least one light-emitting device. The display controller is in communication with the display device and the auxiliary lighting assembly. The display controller transmits a display pulse signal and display data to the display device to cause the display device to present display content associated with one or more casino wagering games by selectively emitting light based on the display pulse signal that defines an active period of light emission and an inactive period without light emission, generates an auxiliary lighting pulse signal based at least partially on one or more signal characteristics of the display pulse signal, synchronizes the auxiliary lighting pulse signal with the display pulse signal, the synchronized lighting pulse signal being phase offset from the display pulse signal, and transmits the synchronized auxiliary lighting pulse signal to the auxiliary lighting assembly to cause the auxiliary lighting assembly to selectively emit light based on the synchronized auxiliary lighting pulse signal. The phase offset between the display pulse signal and the synchronized auxiliary lighting pulse signal causes the auxiliary lighting assembly to emit light during at least a portion of the inactive period of the display device. The gaming system may be incorporated into a single, freestanding gaming machine.

Additional aspects of the invention will be apparent to those of ordinary skill in the art in view of the detailed description of various embodiments, which is made with reference to the drawings, a brief description of which is provided below.

Figure 1:
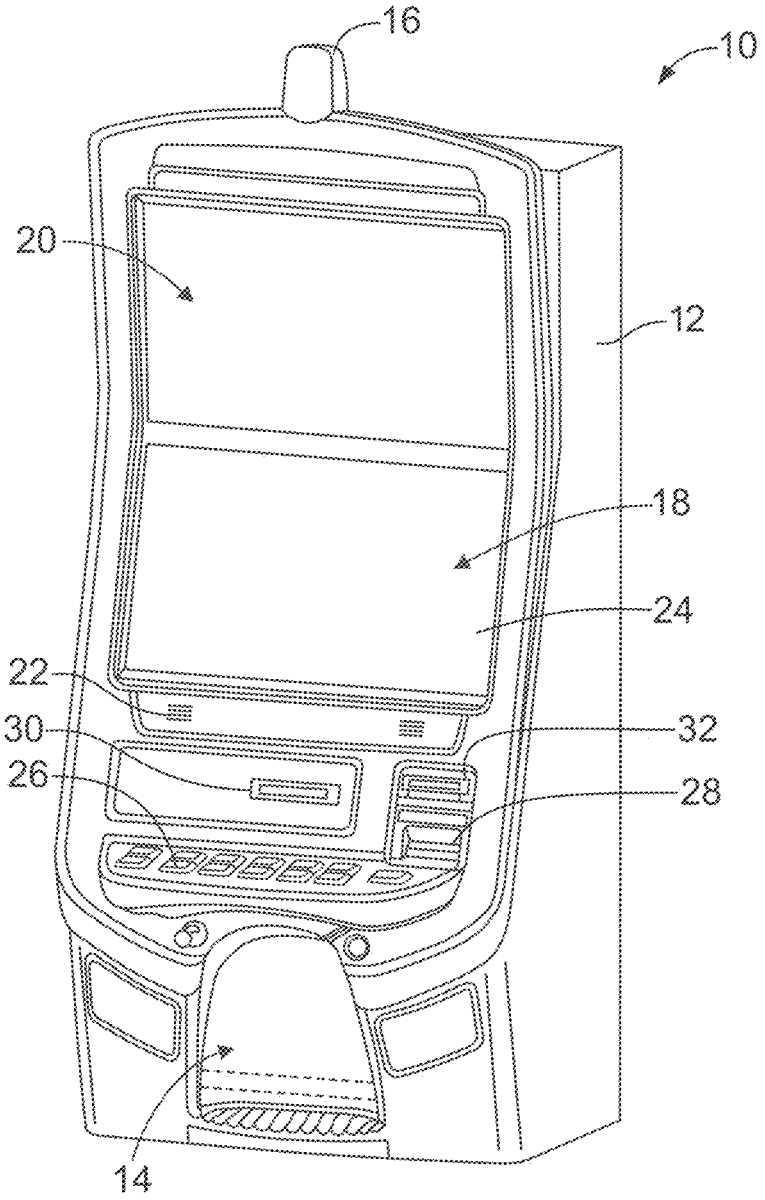
FIG. 1 is a perspective view of a free-standing gaming machine according to one or more embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

As used herein in relation to light emission, the terms "active" and "inactive" refer to two states of light emission. The active state or period is a duration in which a light-emitting device emits light. Some light-emitting devices are capable of emitting light during the active period but do not emit light. For example, if the corresponding pixel is to be black, the light-emitting device may not emit light within the active period. In contrast, during the inactive state or period, the light-emitting device may be prevented from emitting light. In other embodiments, the light-emitting device continues emit light irrespective of the active or inactive state, but rather another mechanism of the display device (e.g., polarizing filters, shutters, etc.) may prevent light from being emitted during the inactive period. The current state of the display device may be determined based on one or more signals. In the example embodiment described herein, a pulse signal is used to determine which state the display device is currently in. For example, the display device may recognize a high value as representing the active period while a low or base value represents the inactive period (i.e., an "active high" signal). In another example, the low value represents the active period while the high value represents the inactive period (i.e., an "active low" signal). The pulse signal may have a fixed period and/or duty cycle, which may be based on the refresh rate of the display device. In other embodiments, other suitable signals having distinctive and identifiable characteristics for both the active and inactive periods may be used in place of the pulse signals described herein.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. In the embodiments described herein, the displays 18, 20 may be associated with one or more auxiliary lighting assemblies (not shown in FIG. 1) that provide emotive or contextual lighting near or surrounding the displays 18, 20 to attract attention and/or enhance the content displayed on the displays 18, 20. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
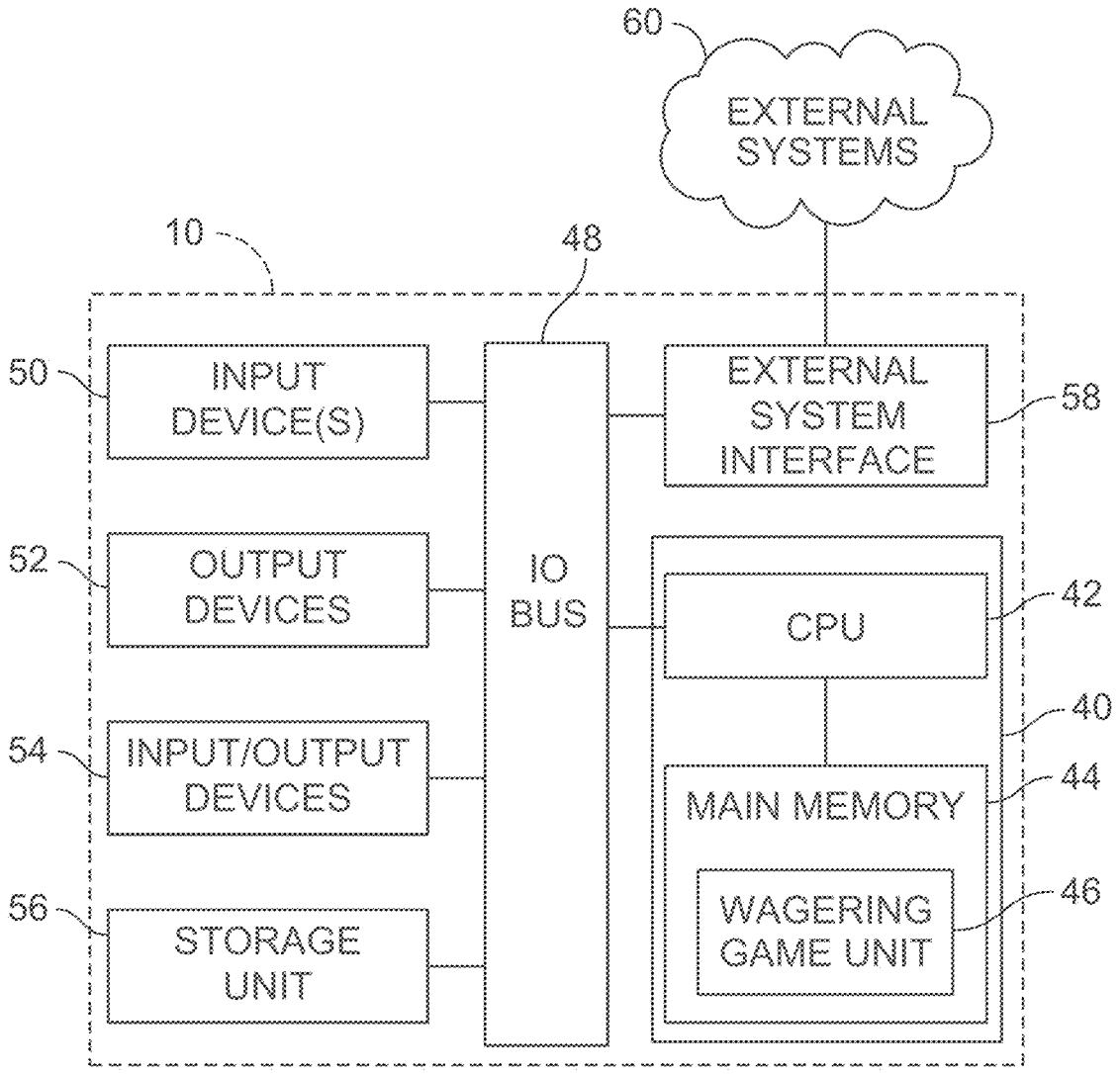
FIG. 2 is a schematic view of a gaming system according to one or more embodiments of the present disclosure.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
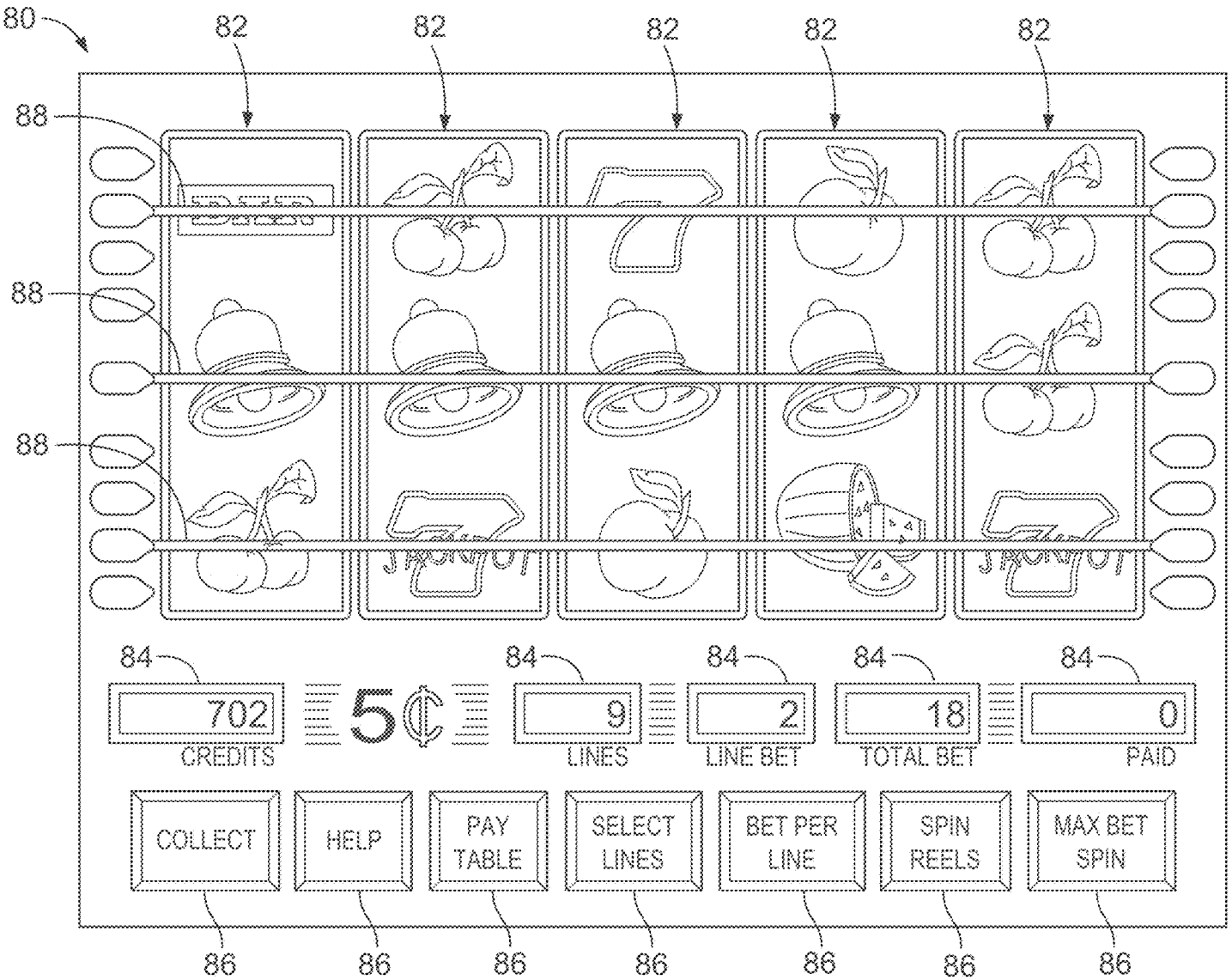
FIG. 3 is an image of an exemplary basic-game screen of a wagering game displayed on a gaming machine, according to one or more embodiments of the present disclosure.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
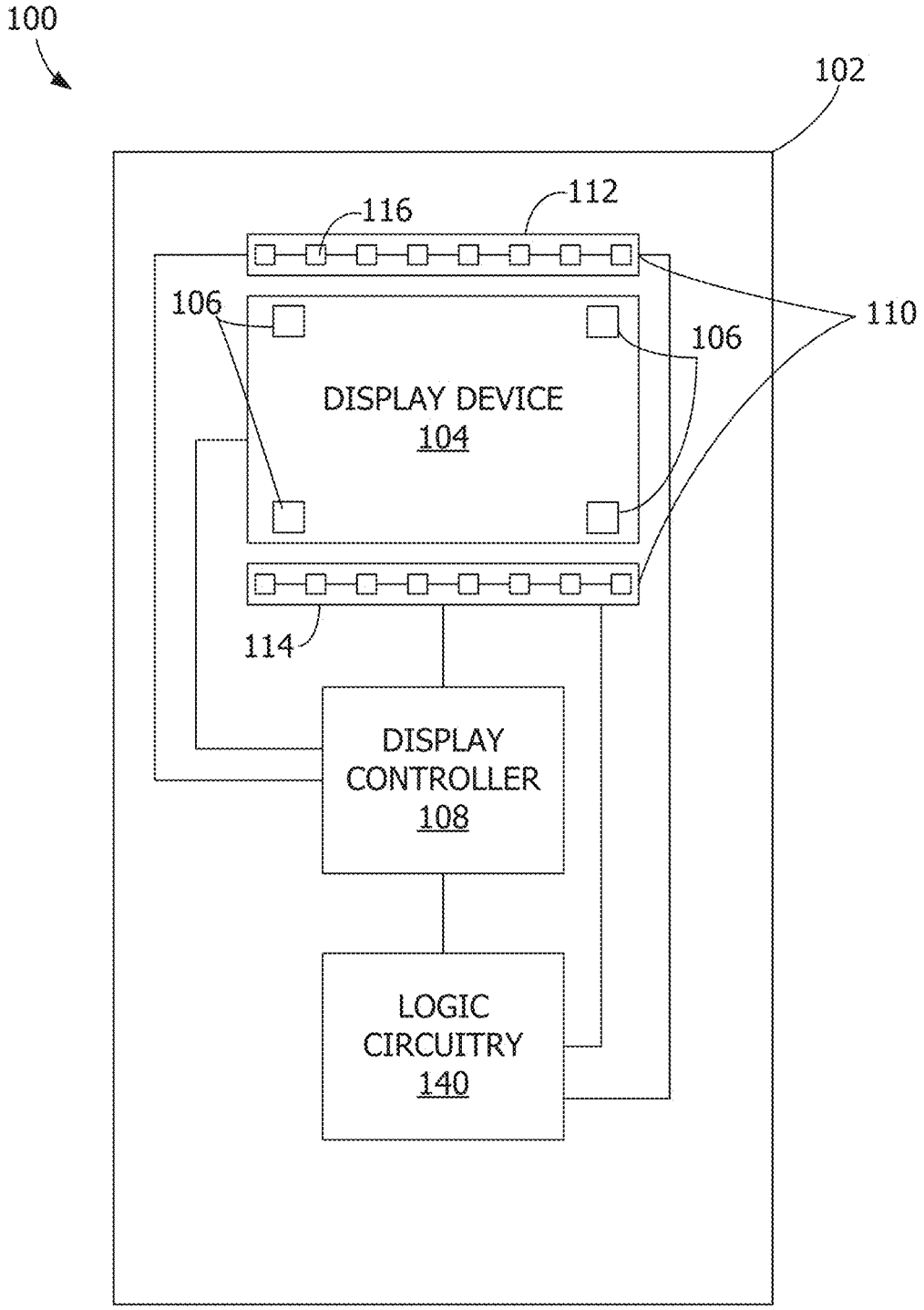
FIG. 4 is a block diagram of a gaming system with a display device and associated lighting assembly according to one or more embodiments of the present disclosure.

FIG. 4 is a block diagram of an example gaming system 100. The system 100 includes a cabinet 102, a display device 104, a display controller 108, an auxiliary lighting assembly 110, and logic circuitry 140. The logic circuitry 140 may be substantially similar to the logic circuitry 40 shown in FIG. 2. The system 100 may be a gaming machine that includes the cabinet 102, the display device 104, the auxiliary lighting assembly 110, and/or the logic circuitry 140. Some of the components (e.g., the logic circuitry 140) may be separate from the gaming machine and in communication with the gaming machine. In other embodiments, the system 100 may include additional, fewer, or alternative components, including those described elsewhere herein. For example, the system 100 may include a plurality of display devices 104 and/or lighting assemblies 106.

The display device 104 is coupled to the cabinet 102 and is configured to present display content associated with one or more casino wagering games. The display device 104 may be any suitable type of sample-and-hold display, such as, and without limitation, LCD, organic light-emitting diode (OLED) displays, light-emitting diode (LED) displays, plasma displays, quantum dot (QLED) displays, and the like. In certain embodiments, the display device 104 may be a projector having a suitable sample-and-hold image technique. In such embodiments, the project may not be coupled to the cabinet 102, but rather a surface for receiving a project image (e.g., a screen) may be coupled to the cabinet 102 and the projector may be positioned remote from the cabinet 102 to project the image on the surface. The display device 104 may include one or more light-emitting devices that selectively emit light to present the display content to a viewer. The emitted light may have certain characteristics (e.g., wavelength) and/or configured to be changed by an additional component of the display device 104, such as polarizing filters, to facilitate various pixel characteristics (e.g., colors, intensity, etc.). In the example embodiment, several example display light-emitting devices 106 are shown, though it is to be understood that the configuration and number of light-emitting devices 106 is for exemplary purposes only. That is, the display light-emitting devices 106 may be configured to operate as a backlight array (i.e., an array of lights positioned behind a screen), edge lighting, and/or other suitable lighting configurations that enable the emitted light to facilitate presentation of the display content.

In the example embodiment, the display device 104 is in communication with the display controller 108 to receive display data, and the display device 104 is configured to present display content based on the display data. The display data may include, for example, video frames that, when presented in sequence, form a video stream. The display content may be, for example, game symbols (e.g., the symbols shown in FIG. 3) and/or other suitable content associated with one or more casino wagering games. In the example embodiment, the display controller 108 is in communication with the logic circuitry 140 to receive the display data. That is, the logic circuitry 140 may be configured to generate display data associated with one or more casino wagering games and transmit the generated display data to the display device 104 via the display controller 108. The display controller 108 may be configured to convert the display data into a format recognized by the display device 104. In other embodiments, the display controller 108 may be integrated with the display device 104 and/or the logic circuitry 140 such that the functionality described herein with the respect to the display controller 104 may be performed using the display device 104 and/or the logic circuitry 140.

In the example embodiment, to present the display content, the display device 104 is configured to selectively emit light from the display light-emitting devices 106. To reduce or otherwise eliminate motion blur between frames displayed by the display device 104, the display controller may stop light emission by the display light-emitting devices 106 between frames, which may also be described as "black frame insertion". To regulate between active and inactive periods of light emission, the display controller 108 may use a display pulse signal or another suitable control signal that defines the frequency and duration of the black frame insertion between frames of display content. As used herein, the display pulse signal defines an "active period" and an "inactive period" for the display device 104. The display pulse signal may be transmitted directly to the display device 104 to cause the display device to control the display light-emitting devices 106 accordingly, or the display controller 108 may adjust the display data based on the display pulse signal prior to transmitting the display data to the display device 104. The display pulse signal may be generated by the display device 104, the display controller 108 and/or the logic circuitry 140. In embodiments in which the display device 104 generates the display pulse signal, the display controller 108 may be configured to receive the display pulse signal from the display device 104. The display pulse signal may be generated based on one or more predefined parameters or signal characteristics. For example, the duty cycle and phase of the display pulse signal may be predefined based on the refresh rate of the display device 104 and/or the frame rate of the display content. In other embodiments, the signal may not be a pulse signal, but rather is another suitable type of signal that has at least two states (i.e., sets of distinctive signal characteristics). The display pulse signal may be used to reduce the complexity and/or resource commitment of the system 100 in relation to discerning which state the signal is currently exhibiting.

In some embodiments, the display pulse signal may not be uniformly applied to the display light-emitting devices 106. That is, the signal may be applied serially, and the light-emitting devices 106 that receive the display pulse signal last may selectively emit light at a delay relative to the light-emitting devices 106 that receive the display pulse signal first. However, in at least some embodiments, the delay may be substantially short enough that visible perception of the delay is relatively low.

As described above, black frame insertion may result in display flicker that is visible to a viewer. To reduce or eliminate this effect, the system 100 includes the auxiliary lighting assembly 110. The auxiliary lighting assembly 110 is configured to emit light at a phase offset from the light emitted by the display device 104 as described herein. If a viewer is located in a position to observe the emitted light from both the display device 104 and the auxiliary lighting assembly 110, the light from the auxiliary lighting assembly 110 may reduce the flicker effect caused by the black frame insertion. For example, if the phase offset is approximately 180° from the display pulse signal, the light from the auxiliary lighting assembly 110 may cause the display device 104 to appear to an observer as having an increased refresh rate, which may reduce the flicker effect of the display device 104 to the point of being imperceptible. The auxiliary lighting assembly 110 and its corresponding functionality described herein may enable the system 100 to gain the benefit of black frame insertion (i.e., reducing motion blur) while reducing or eliminating the unwanted side effect (i.e., flicker) caused by the black frame insertion. For display content involving a substantial amount of moving elements, such as casino wagering games, reducing motion blur and flicker may facilitate improved content presentation for players and observers.

In the example embodiment, the auxiliary lighting assembly 110 includes two subassemblies that are coupled to the cabinet 102 around a peripheral edge of the display device 104. That is, the auxiliary lighting assembly 110 includes a first lighting subassembly 112 positioned near a top edge of the display device 104 and a second lighting assembly 114 positioned near a bottom edge of the display device 104. In other embodiments, the auxiliary lighting assembly 110 may be in another suitable configuration relative to the display device 104. For example, the auxiliary lighting assembly 110 may include fewer or additional lighting subassemblies, such as one or four subassemblies positioned near each edge of the display device 104. In another example, the first and second lighting subassemblies 112, 114 may be positioned at the left and right edges of the display device 104. In certain embodiments, the auxiliary lighting assembly 110 may be at least partially integrated with the display device 104. That is, the auxiliary lighting assembly 110 may be physically coupled to the display device 104, or the display device 104 may incorporate the auxiliary lighting assembly 110.

The auxiliary lighting assembly 110 includes at least one light-emitting device 116 configured to emit light. The light-emitting device 116 may be controllable to emit light having various characteristics (e.g., color, intensity, etc.) and/or may be used in combination with other components that cause the various characteristics of the emitted light, such as a filter. Each light-emitting device 116 may be individually controllable, controllable as subsets, and/or controllable as an entire group. In one example, the light-emitting devices 116 of the first lighting subassembly 112 is controllable separate from the second lighting subassembly 114. In at least some embodiments, the light-emitting devices 116 are oriented to emit light towards a player area of the gaming machine and/or another suitable area in which observers of the display device 104 are likely to be relative to the gaming machine. To facilitate the flicker reduction effect, the position of the light-emitting devices 116 is set such that the emitted light is observable from the player area at the same time as the light emitted by the display device 104. In some embodiments, the position of the light-emitting devices 116 relative to the display device 104 may be determined as a function to improve or maximize the display flicker reduction and/or improve other beneficial features of the auxiliary lighting assembly 110.

In the example embodiment, the display controller 108 and/or the logic circuitry 140 may be configured to control the auxiliary lighting assembly 110. That is, the display controller 108 and/or the logic circuitry 140 may be configured to transmit control values or parameters to the auxiliary lighting assembly 110 that regulate the light emitted by the auxiliary lighting assembly. The display controller 108 and/or the logic circuitry 140 may, for example, generate and transmit one or more control signals to the auxiliary lighting assembly 110 for reducing the flicker effect from the display device 104.

In the example embodiment, as described herein, the display controller 108 is configured to generate an auxiliary lighting pulse signal and transmit the auxiliary lighting pulse signal to the auxiliary lighting assembly 110. In response, the auxiliary lighting assembly 110 is configured to selectively emit light based on the auxiliary lighting pulse signal. Similar to the display pulse signal, the auxiliary lighting pulse signal may define an active period of light emission and an inactive period of light emission for the auxiliary lighting assembly 110. It is to be understood that although the auxiliary lighting pulse signal is described herein as a pulse signal, other suitable types of signals (including a plurality of signals) may be used by the lighting controller 108 to operate the auxiliary lighting assembly 110 as described herein. Moreover, it is to be understood that at least some of the functions described herein of the display controller 108 operating the auxiliary lighting assembly 110 may be performed by the logic circuitry 140 and/or other suitable devices, such as a dedicated lighting controller in communication with the auxiliary lighting assembly 110. In embodiments with other devices controlling the auxiliary lighting assembly 110, signals and/or data stored by the display controller 108, such as the display pulse signal, may be transmitted from the display controller 108 to facilitate the functions described herein.

To achieve flicker reduction for the display device 104, the display controller 108 is configured to synchronize the auxiliary lighting pulse signal to the display pulse signal at a phase offset that causes the auxiliary lighting assembly 110 to emit light (i.e., an active period) at least partially during an inactive period of light emission of the display device 104 (i.e., during a "black frame" in which substantially no light is emitted from the display device 104). In certain embodiments, the phase offset of the auxiliary lighting pulse signal may cause the auxiliary lighting assembly 110 to emit light only during the inactive period of the display device 104 such that the display device 104 and the auxiliary lighting assembly 110 alternate in emitting light over a period of time as described herein with respect to FIGS. 5-10. In at least some embodiments, the phase offset may be between (and including) 90° and 270° relative to the display pulse signal. In one example, the phase offset is 180°. In other embodiments, the phase offset may be another suitable offset relative to the display pulse signal to achieve the flicker effect reduction.

The display controller 108 may retrieve the display pulse signal from internal memory and/or from the display device 104 to determine the phase offset of the auxiliary lighting pulse signal. Any suitable technique for detecting signal timing may be employed to facilitate the synchronous deployment of the auxiliary lighting pulse signal, such as pulse edge detection. Other characteristics of the display pulse signal may be detected by the display controller 108, such as the duty cycle, amplitude, and the like. In some embodiments, at least some signal characteristics of the display pulse signal may be stored by the display device 104 and/or the display controller 108, which may be used to generate the display pulse signal. These stored or detected signal characteristics of the display pulse signal may be used to generate the auxiliary lighting pulse signal, which may account for the duty cycle and/or amplitude in addition to the phase of the display pulse signal.

In certain embodiments, the display controller 108 may be configured to generate a plurality of auxiliary lighting pulse signals. For example, the first lighting subassembly 112 may be controlled by a first lighting pulse signal while the second lighting subassembly 114 may be controlled by a second lighting pulse signal. The phase offset of the first lighting pulse signal relative to the display pulse signal may be different from the phase offset of the second lighting pulse signal. The different phase offsets may account for a delay by the display device 104 in applying the display pulse signal and provide improved synchronize lighting between an edge of the display device 104 and the corresponding subassembly 112, 114. That is, the display light-emitting devices 106 may not be able to switch between active and inactive periods simultaneously—rather, there may be a delay between the top light-emitting devices 106 and the bottom light-emitting devices 106. In one example, the delay may be on the magnitude of several milliseconds. The delay may be a known value for the display device 104 or may be automatically detected by the display controller 108. The display controller 108 may determine the phase offset of each lighting pulse signal based at least partially as a function of the delay, thereby potentially increasing the effectiveness of the flicker effect reduction.

In at least some embodiments, the auxiliary lighting assembly 110 may not be limited to emitting light to reduce flicker perceived on the display device 104. More specifically, the auxiliary lighting assembly 110 may be configured to present emotive lighting for the one or more casino games provided by the system 100. That is, the color and/or intensity of the emitted light by the auxiliary lighting assembly 110 may be used to provide emotive lighting while simultaneously switching between active and inactive periods based on the auxiliary lighting pulse signal. The switching between periods may be substantially imperceptible to observers due to the frequency of the switching and/or the additional light emitted by the system 100 (e.g., the display device 104) and/or other external lighting. In other embodiments, the color and/or intensity (i.e., brightness) of the emitted light may affect the flicker effect reduction. In such embodiments, the auxiliary lighting pulse signal (or an additional control signal) may regulate the color and/or intensity of the auxiliary lighting assembly 110. In at least some embodiments, the emotive lighting scheme may be controlled by a lighting control signal transmitted to the auxiliary lighting assembly 110 separate from the auxiliary lighting pulse signal. The lighting control signal may be generated by the logic circuitry 140 based on a current state of the casino wagering game or by the display controller 108. The lighting control signal may include a plurality of control values, particularly for auxiliary lighting assemblies 110 with a plurality of addressable light-emitting devices 116, thereby enabling multiple emotive lighting effects to occur substantially simultaneously. In other embodiments, the lighting control signal may be combined with the auxiliary lighting pulse signal by the display controller 108 and/or the logic circuitry 140 to generate a hybrid signal for the auxiliary lighting assembly 110.

FIGS. 5-10 depict an example waveform diagram 500 of pulse signals for controlling lighting of the system 100 and accompanying block diagrams of the display device 104 and the auxiliary lighting assembly 110 (each shown in FIG. 4). More specifically, the waveform diagram 500 depicts three pulse signals: (i) a display pulse signal 502, (ii) an auxiliary lighting pulse signal 504, and (iii) observable light signal 506, which is a combination of the display pulse signal 502 and the auxiliary lighting pulse signal 504. In other embodiments, additional, fewer, or alternative signals may be used to control the light emission of the system 100, including those signals described herein.

As described above, the display pulse signal 502 is used to control the light emission by the display device 104. In the example embodiment, the display pulse signal 502 is an active-high signal, where a high value of the display pulse signal 502 is associated with an active period of light emission and a low or base value of the display pulse signal 502 is associated with an inactive period of light emission. In other embodiments, the display pulse signal 502 is an active-low signal.

The auxiliary lighting pulse signal 504 is used to control the light emission by the auxiliary lighting assembly 110. The auxiliary lighting pulse signal 504 may be an active-high or active-low signal. In the example embodiment, similar to the display pulse signal 502, the auxiliary lighting pulse signal 504 is an active-high signal. The auxiliary lighting pulse signal 504 shown in the waveform diagram 500 has been synchronized to the display pulse signal 502 at a phase offset of 180°. The auxiliary lighting pulse signal 504 may have the same or substantially similar duty cycle and/or amplitude as the display pulse signal 502. In other embodiments, the phase offset, the duty, the amplitude, and/or other characteristics of the auxiliary lighting pulse signal 504 may be different from the corresponding signal characteristics of the display pulse signal 502.

The observable light signal 506 may not be an actual signal generated and used by the system 100—rather, the observable light signal 506 depicts what light is seen by a viewer from the display device 104 and the auxiliary lighting assembly 110. As described herein, the light seen by the viewer determines the amount of flicker (if any) a viewer may perceive, and therefore increasing the frequency of the light seen by the viewer may decrease or eliminate (if the flicker is beyond human perception) the flicker effect.

Figure 5:
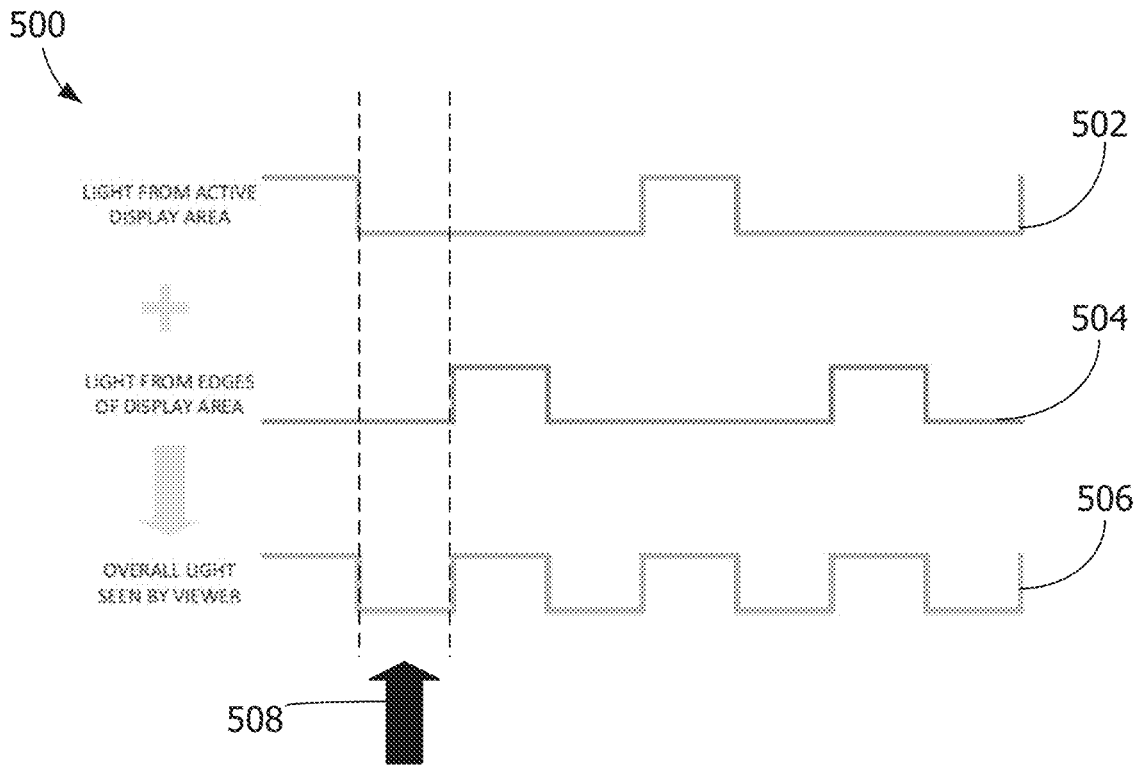
FIG. 5 is an example waveform diagram of display and lighting pulse signals in an example first state according to one or more embodiments of the present disclosure.
Figure 6:
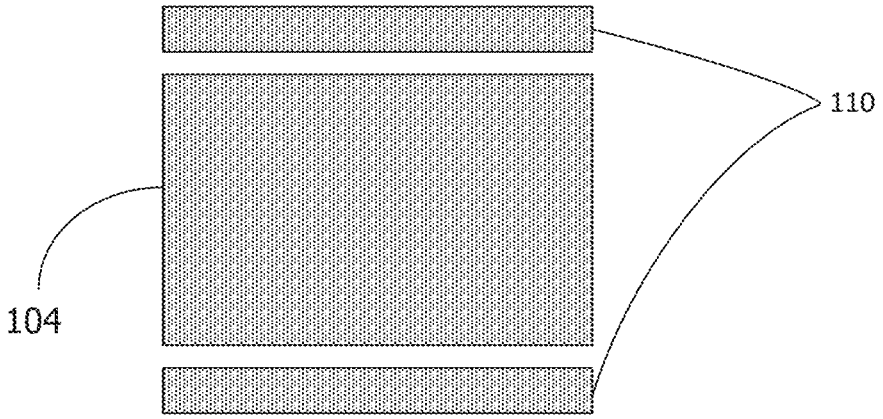
FIG. 6 is an example block diagram of a display device and lighting assembly operating according to the first state shown in FIG. 5 according to one or more embodiments of the present disclosure.

FIG. 5 depicts the waveform diagram 500 in a first state, which is indicated by arrow 508. As both the display pulse signal 502 and the auxiliary lighting pulse signal 504 are active-high signals in the example embodiment, neither the display device 104 nor the auxiliary lighting assembly 110 are in an active period of light emission. FIG. 6 is a block diagram of the display device 104 and the auxiliary lighting assembly 110 in the first state. In particular, both the display device 104 and the auxiliary lighting assembly 110 are shaded in FIG. 6 to illustrate the inactive periods of the display device 104 and the auxiliary lighting assembly 110 in the first state. Active periods shown in FIGS. 8 and 10 may be depicted by the absence of the shading shown in FIG. 6.

Figure 7:
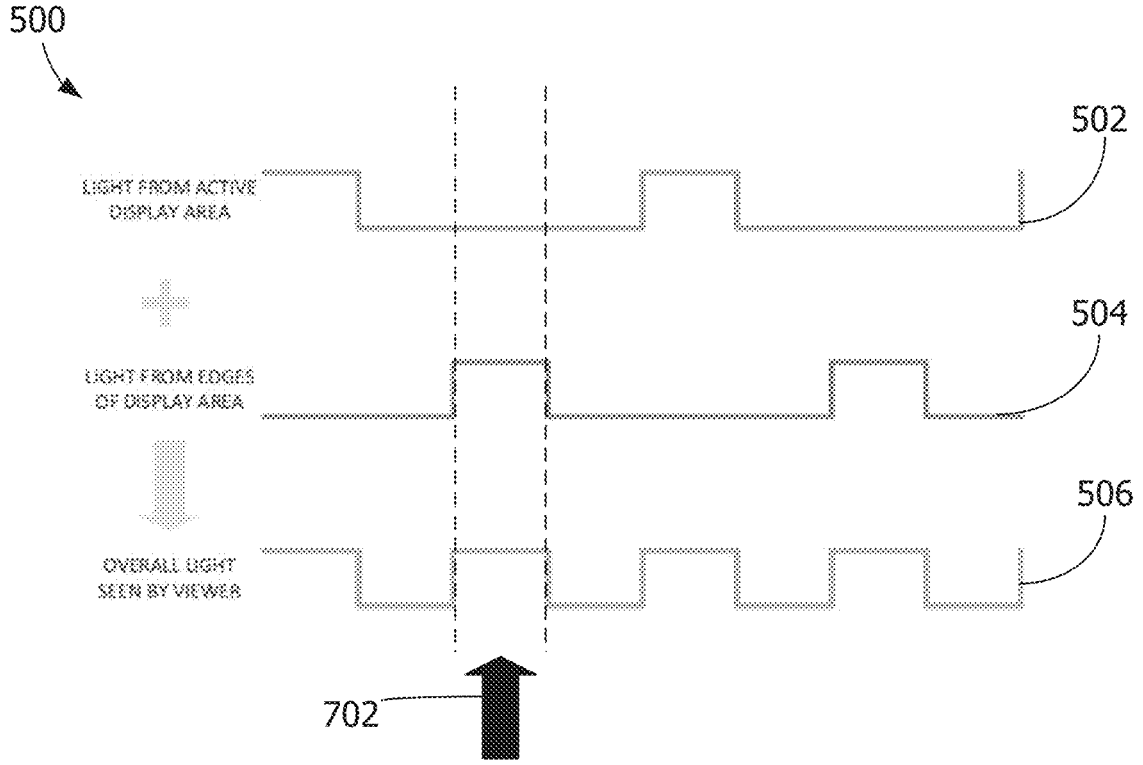
FIG. 7 is the waveform diagram of FIG. 5 in an example second state according to one or more embodiments of the present disclosure.
Figure 8:
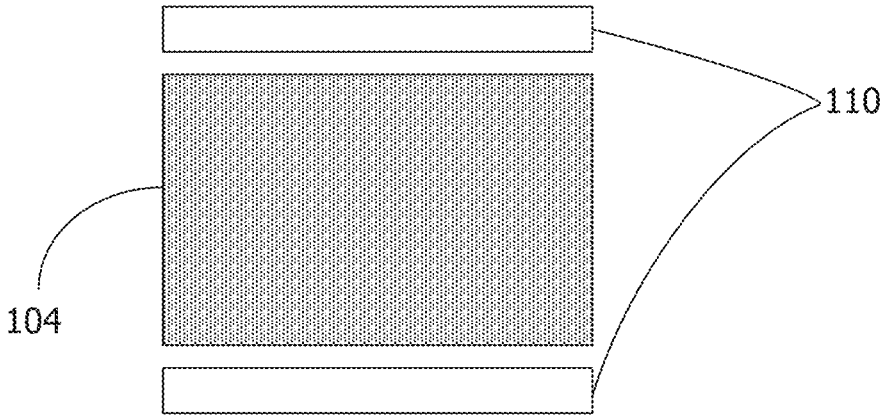
FIG. 8 is an example block diagram of a display device and lighting assembly operating according to the second state shown in FIG. 7 according to one or more embodiments of the present disclosure.

FIG. 7 depicts the waveform diagram 500 in a second state indicated by arrow 702, and FIG. 8 depicts a block diagram of the display device 104 and the auxiliary lighting assembly 110 in the second state. In the second state, the display pulse signal 502 remains the same as the first state at a low or base value while the auxiliary lighting pulse signal 504 is at a high value. As a result, the display device 104 remains in an inactive state or period of light emission while the auxiliary lighting assembly 110 is in an active period of light emission. During the active period of light emission, the auxiliary lighting assembly 110 may selectively emit light to be seen by a viewer (as shown by the observable light signal 506 in the second state). That is, each light-emitting device of the auxiliary lighting assembly 110 may not emit light continuously during the second state, but rather cumulatively, the light-emitting devices of the auxiliary lighting assembly 110 emit light during the second state. For example, the light-emitting devices may operate by continuously switching between on and off during the active period (e.g., when receiving an alternating current power signal). In another example, the auxiliary lighting assembly 110 may be simultaneously presenting emotive lighting, which may include at least some of the light-emitting devices to be off during the active period.

After the second state, the waveform diagram 500 proceeds back to the first state in which the display device 104 and the auxiliary lighting assembly 110 are in inactive periods. Afterwards, the diagram 500 proceeds to a third state shown in FIG. 9 and indicated by arrow 902. In the third state, the display pulse signal 502 is at a high value and the auxiliary lighting pulse signal 504 is at a low or base value. The high and/or low values of the display pulse signal 502 and the auxiliary lighting pulse signal 504 may be substantially similar or different. In certain embodiments, additional information may be indicated by the value of the display pulse signal 502 and/or the auxiliary lighting pulse signal 504. For example, a brightness or intensity parameter may be indicated by the amplitude of the display pulse signal 502 and/or the auxiliary lighting pulse signal 504. In such an example, the pulse signals 502, 504 may be compared to one or more threshold values to determine if the pulse signals 502, 504 represent the active period of light emission and what brightness parameter is indicated by the value of the pulse signals 502, 504. In other embodiments, the amplitude and/or duty cycle of the pulse signals 502, 504 may be associated with other parameters of the display device 104 and/or the auxiliary lighting assembly 110.

Figure 9:
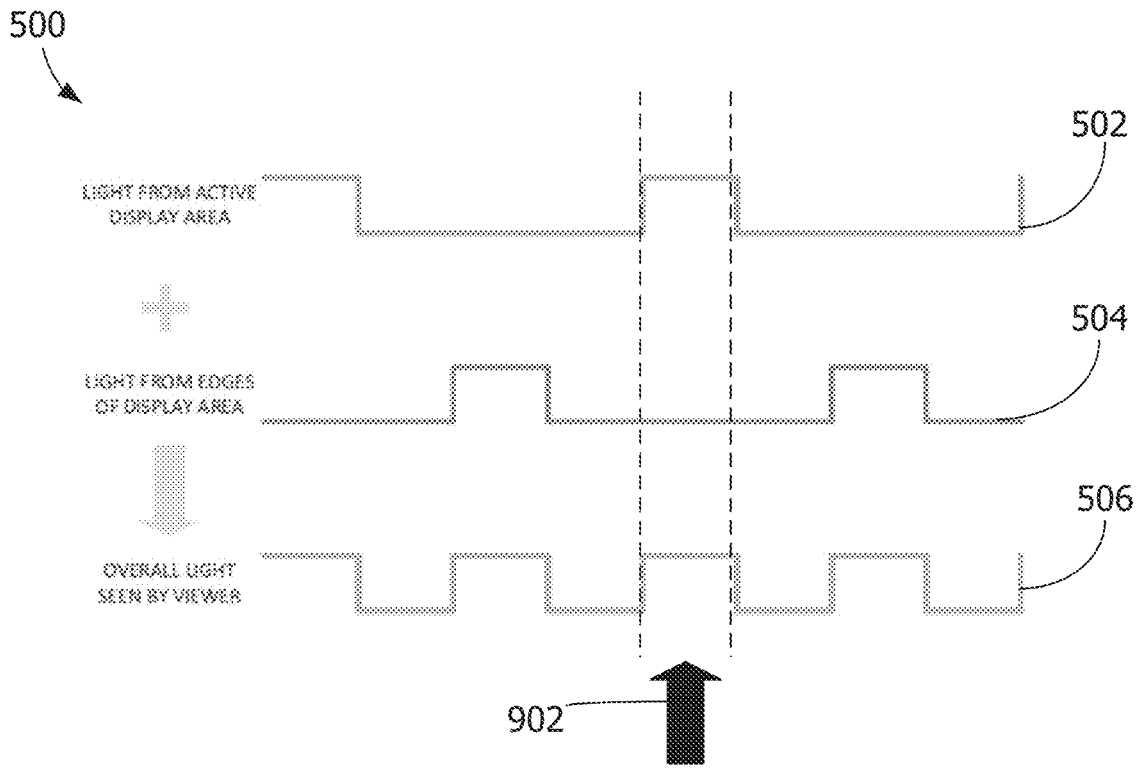
FIG. 9 is the waveform diagram of FIG. 5 in an example second third state according to one or more embodiments of the present disclosure.
Figure 10:
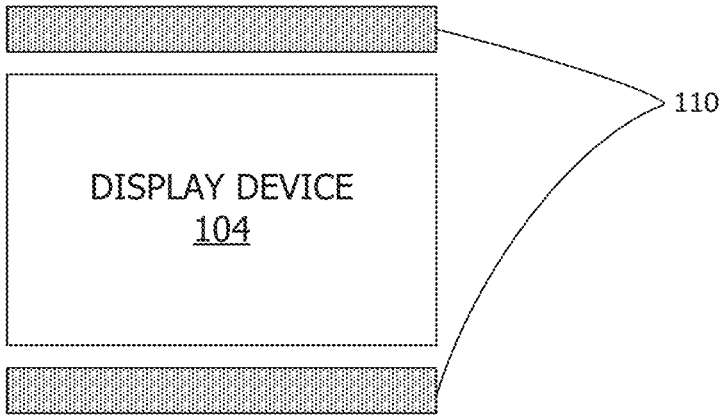
FIG. 10 is an example block diagram of a display device and lighting assembly operating according to the third state shown in FIG. 9 according to one or more embodiments of the present disclosure.

FIG. 10 depicts the display device 104 and the auxiliary lighting assembly 110 in the third state shown in FIG. 9. In particular, the display device 104 is in an active period of light emission and the auxiliary lighting assembly 110 is in an inactive period of light emission. Similar to the auxiliary lighting assembly 110, every light-emitting device of the display device 104 is not necessarily emitting light continuously during the active period, but rather, collectively, the light-emitting devices emit light that is seen or perceived by the viewer as shown by the observable light signal 506 in the third state. For example, some light-emitting devices may be turn off during the active period if the corresponding pixels of the display device 104 are to be black for the presented display content.

After the third state, the waveform diagram proceeds back to the first state to repeat the state progression shown in FIGS. 5, 7, and 9. The reduction of display flicker by the system 100 is shown in the comparison between the display pulse signal 502 and the observable light signal 506. That is, display flicker is at least partially a function of the light perceived by a viewer. Without the light emitted by the auxiliary lighting assembly 110 in combination with the black frame insertion employed by the display device 104 to reduce motion blur, the light perceived by the viewer is limited to the third state shown in FIG. 9. The extended periods of inactive light emission may be perceptible by at least some viewers of the display device 104. However, introducing the auxiliary lighting assembly 110 and causing the assembly 110 to emit light at a phase offset of the display pulse signal 502 may facilitate reduced flicker by increasing the frequency of active periods of light emission relative to inactive periods. In the example embodiment, the effective frequency of active periods of light emission shown by the observable light signal 506 is double the frequency of the display pulse signal 502. In one example, the display pulse signal 502 may have a frequency of 60 Hz, and the auxiliary lighting pulse signal 504 also has a frequency of 60 Hz at a phase offset from the display pulse signal of 180°. The 60 Hz refresh rate of the display device 104, when combined with black frame insertion, may cause the flicker effect to be perceptible. However, the effective refresh rate of the light perceived by the viewer from the system 100 may be approximately 120 Hz, which may be beyond the limits of human perception of the flicker effect, thereby potentially resulting in improved presentation of display content.

In other embodiments, the pulse signals 502, 504 (and, by extension, the observable light signal 506) may employ other suitable waveforms. For example, the phase offset may be different such that the pulse signals 502, 504 at least partially overlap, thereby eliminating an intervening first state between the pulse signals 502, 504. In another example, the frequency of the pulse signals 502, 504 may be different. For example, the auxiliary lighting pulse signal 504 may have a frequency of 120 Hz while the display pulse signal has a frequency of 60 Hz. The signal characteristics of the pulse signals 502, 504 may be adjusted in other suitable manners to form a desired observable light signal 506. For example, if the auxiliary lighting pulse signal 504 is divided into a plurality of lighting pulse signals to control a plurality of subassemblies, the phase offset of each lighting pulse signal may be adjusted to match the corresponding edge of the display 104, thereby potentially providing improved effectiveness of the display flicker reduction provided by the auxiliary lighting assembly 110.

Figure 11:
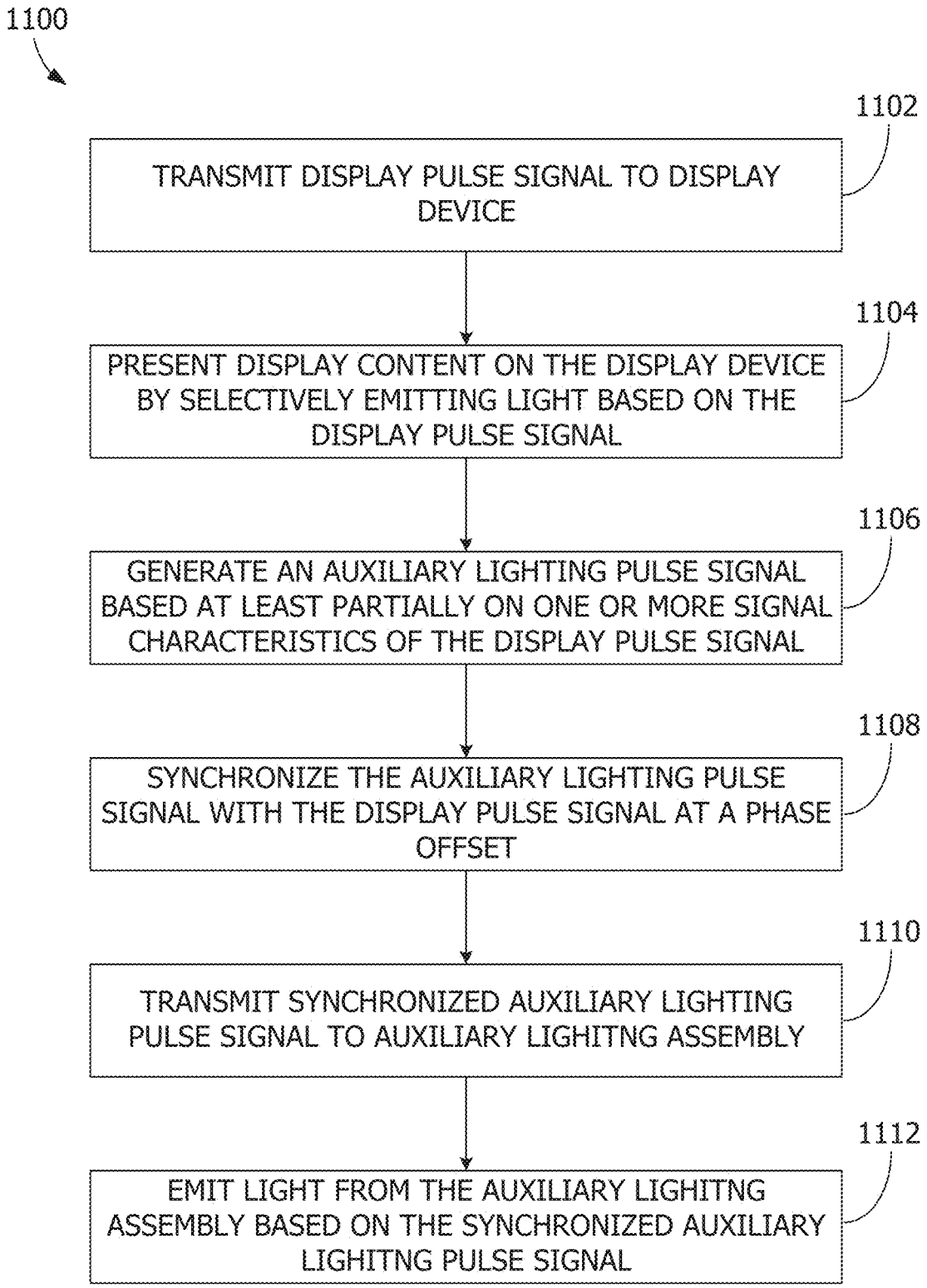
FIG. 11 is a flow diagram of an example method for reducing flicker from display devices in an example gaming system in accord with at least some aspects of the disclosed concepts.

FIG. 11 is a flow diagram of an example method 1100 for reducing display flicker using the system 100 shown in FIG. 4. It is to be understood that at least some of the steps of the method 1100 described herein as performed by the display controller 108 may instead be performed by the display device 104, the logic circuitry 140, and/or a dedicated lighting controller of the system 100. Moreover, the steps of the method 1100 may be performed for a plurality of display devices 104 and/or auxiliary lighting assemblies 110 of the system 100. In other embodiments, the method 1100 may include additional, fewer, or alternative steps, including those described elsewhere herein.

In the example embodiment, the display controller 108 transmits 1102 a display pulse signal to the display device 104. The display pulse signal may be generated by the display controller 108, retrieved from memory, or received from another device (e.g., the logic circuitry 140). The display pulse signal may be transmitted 1102 in combination with or in parallel to display data associated with display content for the display device 104. The display device 104 receives the display data and the display pulse signal from the display controller 108 and/or the logic circuitry 140. In some embodiments, the display pulse signal may be stored by the display device 104 such that the display pulse signal may not be continuously transmitted by the display controller 108, but rather the display device 104 may generate the display pulse from local memory for subsequent use. The display device 104 presents 1104 display content from the display data by selectively emitting light based on the display pulse signal. More specifically, during periods of active light emission, frames of the display content are illuminated and perceived by a viewer, while periods of inactive light emission are inserted to reduce motion blur between frames of display content.

The display controller 108 generates 1106 an auxiliary lighting pulse signal based at least partially on one or more signal characteristics of the display pulse signal. The signal characteristics may include, but are not limited to, frequency, phase, amplitude, duty cycle, and the like. In one example, the auxiliary lighting pulse signal may be generated 1106 with a substantially similar frequency and/or duty cycle relative to the display pulse signal. The display controller 108 then synchronizes 1108 the auxiliary lighting pulse signal to the display pulse signal at a phase offset. In one example, the auxiliary lighting pulse signal is synchronized 1108 at a 180° phase offset relative to the phase of the display pulse signal. Synchronizing 1108 may be performed by analyzing the timing of the display pulse signal, which may including pulse edge detection by the display device 104 and/or the display controller 108. The synchronized auxiliary lighting pulse signal is then transmitted 1110 by the display controller 108 to the auxiliary lighting assembly 110. In some embodiments, the auxiliary lighting pulse signal may be include a plurality of lighting pulse signals. Each lighting pulse signal may be synchronized 1108 at a respective phase offset and transmitted to a corresponding lighting subassembly 112, 114 of the auxiliary lighting assembly 110.

The auxiliary lighting assembly 110 receives the synchronized auxiliary lighting pulse signal and emits 1112 light based on the synchronized auxiliary lighting pulse signal. The phase offset of the synchronized auxiliary lighting pulse signal causes the lighting assembly 110 to emit light during at least a portion of an inactive period of light emission for the display device 104, thereby increasing the frequency and/or duty cycle of the emitted light seen by a viewer and potentially reducing or eliminated display flicker perceived by the viewer. In at least some embodiments, the emitted light may be according to an emotive lighting scheme to present emotive lighting in combination with the display content on the display device 104 for the casino wagering games. More specifically, the auxiliary lighting assembly may receive a lighting control signal from the display controller 108, the logic circuitry 140, and/or a dedicated lighting controller that causes the auxiliary lighting assembly 110 to present the emotive lighting.

Although the foregoing embodiments are directed to gaming systems including display devices, it is to be understood that at least some of the disclosed concepts may be incorporated into systems that may not be dedicated to gaming. For example, televisions and kiosks that are not dedicated to gaming may include one or more lighting assemblies to reduce display flicker.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A gaming machine comprising:

a cabinet;

an auxiliary lighting assembly coupled to the cabinet, the auxiliary lighting assembly comprising at least one light-emitting device;

a display device coupled to the cabinet, wherein the auxiliary lighting assembly is coupled to the cabinet adjacent to the display device; and a display controller in communication with the display device and the auxiliary lighting assembly, the display controller configured to:

transmit a display pulse signal and display data to the display device to cause the display device to present display content associated with one or more casino wagering games by selectively emitting light based on the display pulse signal, the display pulse signal defining an active period of light emission and an inactive period without light emission;

generate an auxiliary lighting pulse signal based at least partially on one or more signal characteristics of the display pulse signal;

synchronize the auxiliary lighting pulse signal with the display pulse signal, the synchronized lighting pulse signal being phase offset from the display pulse signal between 90° and 270°; and transmit the synchronized auxiliary lighting pulse signal to the auxiliary lighting assembly to cause the auxiliary lighting assembly to selectively emit light based on the synchronized auxiliary lighting pulse signal, wherein the phase offset between the display pulse signal and the synchronized auxiliary lighting pulse signal causes the auxiliary lighting assembly to emit light during at least a portion of the inactive period of the display device.

2. The gaming machine of claim 1, wherein the phase offset approximately 180°.

3. The gaming machine of claim 1, wherein the phase offset of the synchronized lighting pulse signal causes the auxiliary lighting assembly to be inactive during the active period of the display device.

4. The gaming machine of claim 1, wherein the auxiliary lighting assembly is coupled to the cabinet proximate to a periphery of the display device.

5. The gaming machine of claim 1, wherein the auxiliary lighting assembly is configured to emit emotive lighting associated with the one or more casino wagering games based at least partially on a lighting control signal generated by logic circuitry of the gaming machine.

6. The gaming machine of claim 1, wherein the auxiliary lighting assembly comprises a first lighting subassembly and a second lighting subassembly and the auxiliary lighting pulse signal comprises a first lighting pulse signal and a second lighting pulse signal, and wherein the first lighting subassembly is configured to selectively emit light based on the first lighting pulse signal and the second lighting subassembly is configured to selectively emit light based on the second lighting pulse signal.

7. The gaming machine of claim 6, wherein the first lighting pulse signal is synchronized to the display pulse signal at a first phase offset and the second lighting pulse signal is synchronized to the display pulse signal at a second phase offset different from the first phase offset.

8. A method for reducing flicker caused by display devices using a gaming system, the gaming system including a cabinet, an auxiliary lighting assembly coupled to the cabinet and including at least one light-emitting device, a display device coupled to the cabinet, and a display controller in communication with the display device and the auxiliary lighting assembly, wherein the auxiliary lighting assembly is coupled to the cabinet adjacent to the display device, the method comprising:

transmitting, by the display controller, a display pulse signal and display data to the display device to cause the display device to present display content associated with one or more casino wagering games by selectively emitting light based on the display pulse signal, the display pulse signal defining an active period of light emission and an inactive period without light emission;

generating, by the display controller, an auxiliary lighting pulse signal based at least partially on one or more signal characteristics of the display pulse signal;

synchronizing, by the display controller, the auxiliary lighting pulse signal with the display pulse signal, the synchronized lighting pulse signal being phase offset from the display pulse signal between 90° and 270°; and transmitting, by the display controller, the synchronized auxiliary lighting pulse signal to the auxiliary lighting assembly to cause the auxiliary lighting assembly to selectively emit light based on the synchronized auxiliary lighting pulse signal, wherein the phase offset between the display pulse signal and the synchronized auxiliary lighting pulse signal causes the auxiliary lighting assembly to emit light during at least a portion of the inactive period of the display device.

9. The method of claim 8, wherein the phase offset is approximately 180°.

10. The method of claim 8, wherein the phase offset of the synchronized lighting pulse signal causes the auxiliary lighting assembly to be inactive during the active period of the display device.

11. The method of claim 8, wherein the auxiliary lighting assembly is coupled to the cabinet proximate to a periphery of the display device.

12. The method of claim 8, wherein the auxiliary lighting assembly is coupled to the cabinet proximate to each peripheral edge of the display device.

13. The method of claim 8, wherein the auxiliary lighting assembly is configured to emit emotive lighting associated with the one or more casino wagering games based at least partially on a lighting control signal generated by logic circuitry of the gaming machine.

14. The method of claim 8, wherein the auxiliary lighting assembly comprises a first lighting subassembly and a second lighting subassembly and the auxiliary lighting pulse signal comprises a first lighting pulse signal and a second lighting pulse signal, and wherein the first lighting subassembly is configured to selectively emit light based on the first lighting pulse signal and the second lighting subassembly is configured to selectively emit light based on the second lighting pulse signal.

15. The method of claim 14, wherein the first lighting pulse signal is synchronized to the display pulse signal at a first phase offset and the second lighting pulse signal is synchronized to the display pulse signal at a second phase offset different from the first phase offset.

16. A gaming system comprising:

a gaming machine comprising a cabinet, a display device, and an auxiliary lighting assembly comprising at least one light-emitting device, wherein the display device is coupled to the cabinet and the auxiliary lighting assembly is coupled to the cabinet adjacent to the display device; and a display controller in communication with the display device and the auxiliary lighting assembly, the display controller configured to:

transmit a display pulse signal and display data to the display device to cause the display device to present display content associated with one or more casino wagering games by selectively emitting light based on the display pulse signal, the display pulse signal defining an active period of light emission and an inactive period without light emission;

generate an auxiliary lighting pulse signal based at least partially on one or more signal characteristics of the display pulse signal;

synchronize the auxiliary lighting pulse signal with the display pulse signal, the synchronized lighting pulse signal being phase offset from the display pulse signal between 90° and 270°; and transmit the synchronized auxiliary lighting pulse signal to the auxiliary lighting assembly to cause the auxiliary lighting assembly to selectively emit light based on the synchronized auxiliary lighting pulse signal, wherein the phase offset between the display pulse signal and the synchronized auxiliary lighting pulse signal causes the auxiliary lighting assembly to emit light during at least a portion of the inactive period of the display device.

17. The gaming system of claim 16, wherein the phase offset is approximately 180°.

18. The gaming system of claim 16, wherein the auxiliary lighting assembly is coupled to the cabinet proximate to a periphery of the display device.

19. The gaming system of claim 16, wherein the gaming machine includes the display controller.

20. The gaming system of claim 16, wherein the auxiliary lighting assembly comprises a first lighting subassembly and a second lighting subassembly and the auxiliary lighting pulse signal comprises a first lighting pulse signal and a second lighting pulse signal, and wherein the first lighting subassembly is configured to selectively emit light based on the first lighting pulse signal and the second lighting subassembly is configured to selectively emit light based on the second lighting pulse signal.

* * * * *